US005941619A

United States Patent [19]

Stieben et al.

[11] Patent Number: 5,941,619

[45] Date of Patent: Aug. 24, 1999

[54] ELECTRICAL CONNECTOR FOR A REFRIGERATOR AND METHOD OF INSTALLING

[75] Inventors: William V. Stieben; Rick L. Gunderson, both of Greenville, Mich.; Ronald G. Prusinski, Plymouth, Ind.; Robert J. Turnbull, Greenville, Mich.

[73] Assignee: White Consolidated Industries, Inc., Cleveland, Ohio

[21] Appl. No.: 08/936,342

[22] Filed: Sep. 24, 1997

[51] Int. Cl.[6] ..... F25D 23/12

[52] U.S. Cl. ..... 312/223.6; 16/223; 49/381; 312/405

[58] Field of Search ..... 62/440, 441; 403/391, 403/389; 49/381; 248/65, 68.1; 312/223.6, 401, 405, 405.1, 400, 116, 138.1, 329, 326; 138/109, 106; 174/49; 254/29 R, 134.3 FT; 52/220.1, 220.8; 222/146.1, 146.6; 16/223, 2.1

[56] References Cited

U.S. PATENT DOCUMENTS

| | | | |
|---|---|---|---|
| 1,997,430 | 4/1935 | Peirce, Jr. | 403/391 X |
| 2,665,414 | 1/1954 | Hubacker et al. | 16/223 X |
| 2,786,338 | 3/1957 | Wurtz et al. | 222/146.6 X |
| 2,982,586 | 5/1961 | Gliebe | 403/326 X |
| 3,140,077 | 7/1964 | Truman . | |
| 3,590,855 | 7/1971 | Wollen | 222/146.1 X |
| 4,036,620 | 7/1977 | Benasutti et al. . | |
| 4,097,096 | 6/1978 | Kochendorfer . | |
| 4,332,429 | 6/1982 | Frick et al. . | |
| 4,543,800 | 10/1985 | Mawby et al. . | |
| 4,609,234 | 9/1986 | Naniwa et al. . | |
| 4,715,512 | 12/1987 | Buchser . | |
| 4,715,831 | 12/1987 | Paddock . | |
| 4,912,942 | 4/1990 | Katterhenry et al. . | |
| 5,016,859 | 5/1991 | Zimmer et al. . | |
| 5,064,970 | 11/1991 | Bennett et al. . | |
| 5,238,299 | 8/1993 | McKinney . | |
| 5,240,209 | 8/1993 | Kutsch | 248/68.1 X |
| 5,248,196 | 9/1993 | Lynn et al. . | |
| 5,263,509 | 11/1993 | Cherry et al. . | |
| 5,359,795 | 11/1994 | Mawby et al. . | |
| 5,787,724 | 8/1998 | Pohl et al. | 312/405 X |

*Primary Examiner*—Peter M. Cuomo
*Assistant Examiner*—Janet M. Wilkens
*Attorney, Agent, or Firm*—Pearne, Gordon, McCoy & Granger LLP

[57] ABSTRACT

An improved electrical connector assembly and a method for installing the same quickly and efficiently in a refrigerator door conduit. The assembly provides a hollow member, or water tube, and an electrical connector having a locator and a stop surface. The method involves assembling the electrical connector and the hollow member by placing the locator within the hollow member and applying a force on the hollow member to push the electrical connector through the conduit.

13 Claims, 4 Drawing Sheets

ELECTRICAL CONNECTOR FOR A REFRIGERATOR AND METHOD OF INSTALLING

BACKGROUND OF THE INVENTION

This invention relates generally to refrigerators, and more particularly to refrigerator door panels having devices requiring a source of water and electrical power. More specifically, the invention relates to an electrical connector assembly for delivering water and electricity to the devices and a method of installing the connector in the refrigerator.

It has become very common to provide through-the-door ice and water dispensing devices, along with a light, on a freezer door of a refrigerator. See, for example, the patent of Harold S. Mawby et al, U.S. Pat. No. 5,359,795, granted Nov. 1, 1994 and assigned to the Assignee of the present invention. In order to operate, these devices require a supply of water and electricity. The doors are manufactured with a conduit or tube in which electrical wires and a water tube pass for this purpose. The conduit generally extends from the devices to a lower door hinge where the wires and water tube pass through a hole in the hinge and continue into the refrigerator to respective sources of electrical power and water.

At present, however, there is no convenient way to install the wires and water tube in the conduit in a fast and efficient way.

SUMMARY OF THE INVENTION

The present invention overcomes this disadvantage by providing an improved electrical connector assembly and a method for installing the same quickly and efficiently in a refrigerator door conduit.

The electrical connector assembly provides a hollow member and an electrical connector having an anterior end and a posterior end. A locator protrudes from the posterior end of the connector. A stop surface is provided adjacent the locator. The connector has passages extending between the posterior and anterior ends and disposed within the passages are sleeve connectors and wires. Preferably, a water tube serves as the hollow member.

The method of installing the connector involves performing the steps of assembling the electrical connector and the hollow member by placing the locator within the hollow member, aligning the anterior end of the electrical connector with an end of the conduit, and applying a force to the hollow member so that the hollow member asserts a force on the stop surface thereby forcing the electrical connector through the conduit.

In further accordance with the method, the electrical connector is mated with a mating electrical connector and the water tube, if serving as the hollow member, is mated with a water supply.

BRIEF DESCRIPTION OF THE DRAWINGS

These and further features of the present invention will be apparent with reference to the following description and drawings, wherein.

DESCRIPTION OF THE PREFERRED EMBODIMENTS

It should be noted that in the detailed description which follows, identical components have been given the same references numerals, and that, in order to clearly and concisely illustrate the present invention, certain features may be shown in somewhat schematic form.

Figure 1:
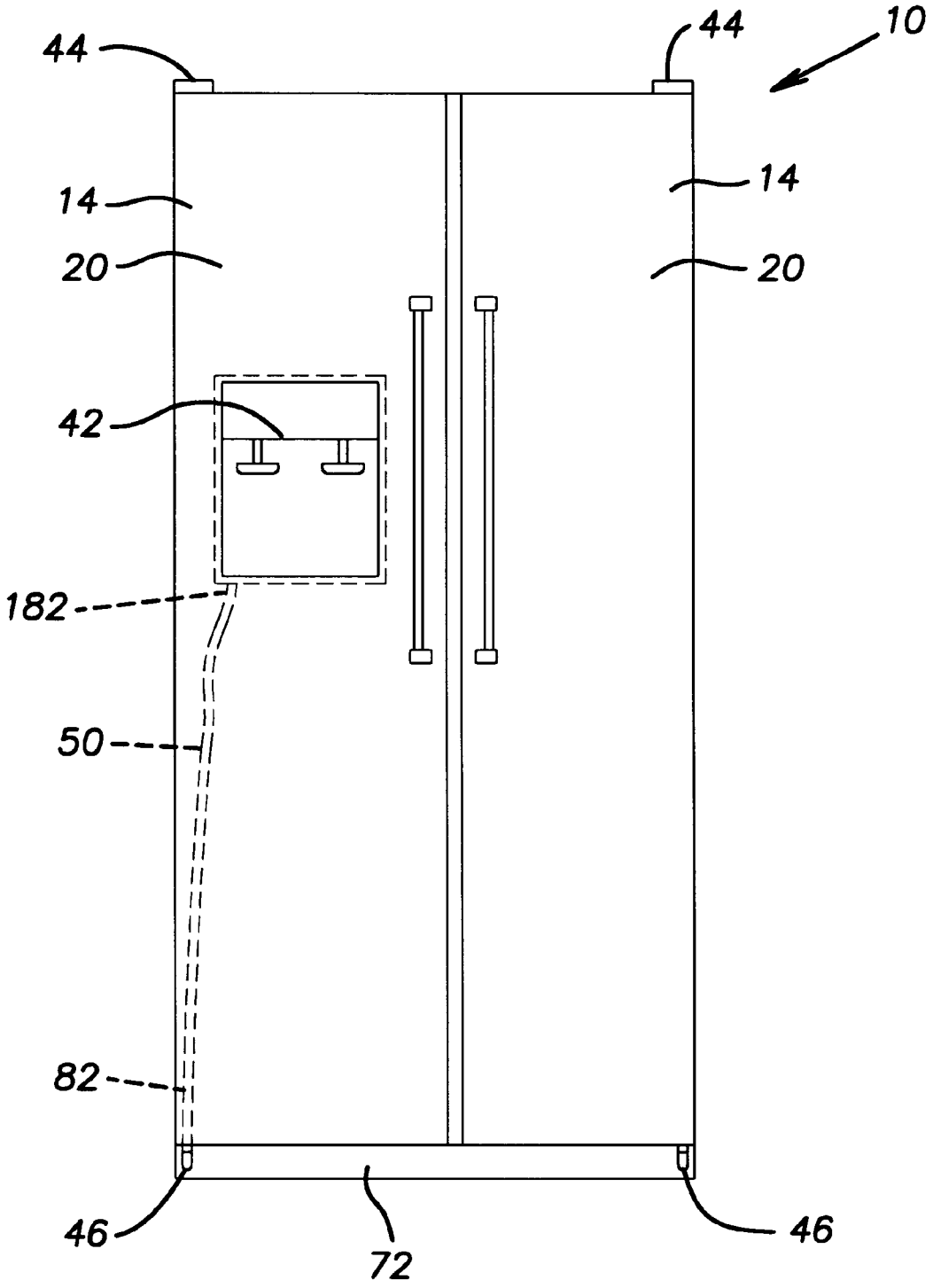
FIG. 1 is a front view of a refrigerator showing a door hinge and a conduit.
Figure 10:
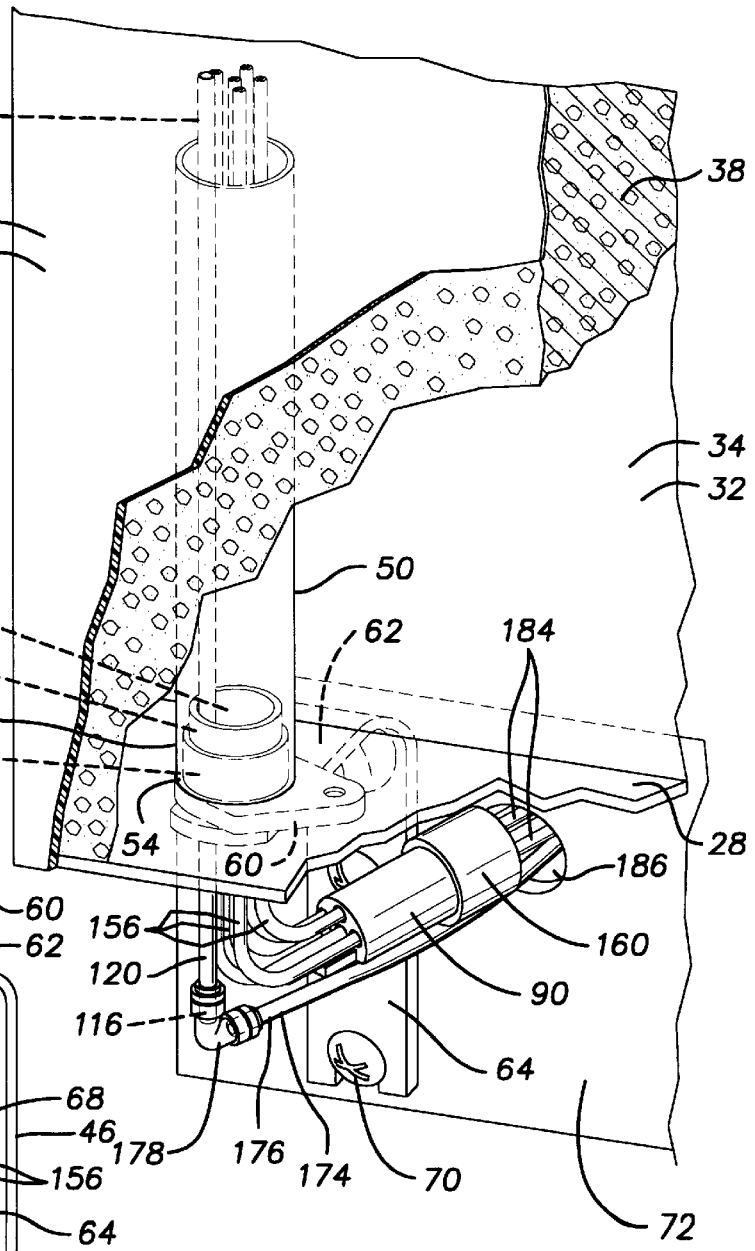
FIG. 10 is a perspective view of the electrical connector assembly after it has been installed in the refrigerator.

FIG. 1 shows a side-by-side refrigerator 10 having two doors 14. The doors 14 are typically made from a sheet metal outer panel 20 having inturned edges forming lateral sides (not shown), top (not shown) and bottom 28 surfaces of the doors 14 (FIG. 10). A plastic liner 32, attached to the sides, top and bottom surfaces of the door 14, serves as an inner panel 34. Insulating foam 38 is used to fill the space between the outer 20 and inner 34 panels. Although a side-by-side refrigerator 10 is shown, it is understood that a top or bottom freezer refrigerator may be substituted for the one shown. For more information regarding the construction of refrigerator doors, see the patent of Harold S. Mawby et al, U.S. Pat. No. 5,359,795, granted Nov. 1, 1994 and assigned to the Assignee of the present invention and incorporated herein by reference.

One of the doors 14 is provided with devices 42 that require a supply of water and electricity. Such devices 42 may include a through-the-door ice dispenser, water dispenser, light, and so forth. Each door 14 is supported by an upper door hinge 44 and a lower door hinge 46. The door 14 having the devices 42 has a conduit 50 located in the space between the outer and inner door panels 20, 34. The conduit 50 extends from the devices 42 to the lower door hinge 46.

Referring now to FIG. 10, a portion of the door 14 and the lower hinge 46 are shown, with a portion of the outer panel 20 and insulating foam 38 broken away. The bottom 28 of the door 14 has a hole 54. A bushing 58, made of brass or other suitable material, lines the hole 54. The bushing 58 is provided with a toe section 60. The toe section 60 is secured to the bottom of the door bottom 28 by a screw (not shown) or other suitable fastening means. The lower door hinge 46 is an L-shaped bracket having an upper arm 62 and a lower arm 64. The lower arm 64 is provided with holes 68 (FIG. 9) to receive screws 70 for securing the hinge 46 to a toeplate 72 (FIGS. 1 and 10). The upper arm 62 is provided with a tubular section 76 which passes through the bushing 58. Hence, the toe section 60 of the bushing 58 rests on the upper arm 62 of the hinge 46 and the door 14 is then free to rotate about the tubular section 76. The center of the tubular section 76 is hollow and defines a hole 78. The conduit 50 has a hinge end 82 that surrounds the tubular section 76 and the bushing 58, effectively making the tubular section 76 an extension of the conduit 50.

Referring now to FIGS. 2 through 5, an electrical connector 90 is shown. The electrical connector 90 has a body section 92 with an anterior end 94 and a posterior end 96. The cross-sectional shape of the electrical connector 90 (FIGS. 3 and 4) is shown as being D-shaped having a flat part 100 and a curved part 102. The anterior end 94 may be beveled 106 as shown around the curved part 102. As will be discussed in greater detail below, the bevel 106 is used to assist in installing the connector 90 in the conduit 50. Note that the electrical connector 90 does not necessarily have to be D-shaped, but may have any shape that will fit inside the conduit 50 and hole 78 in the hinge 46. The flat part 100 of the electrical connector 90 has a catch 108. As will be discussed in more detail below, the catch 108 is used help secure the connector 90 after it is installed in the refrigerator 10.

Figure 2:
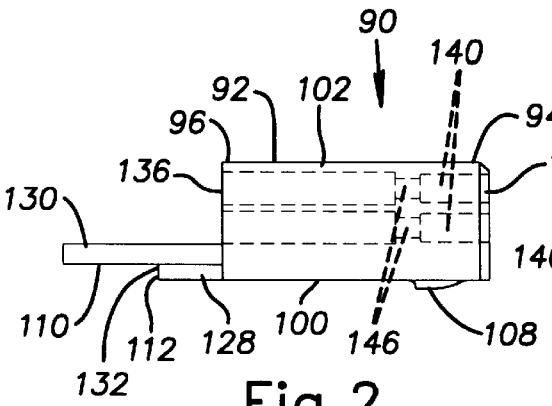
FIG. 2 is a side view of an electrical connector.
Figure 3:
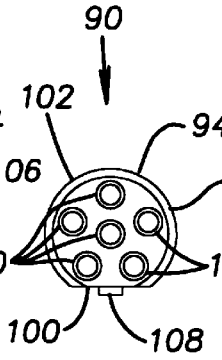
FIG. 3 is an anterior end view of the electrical connector.
Figure 4:
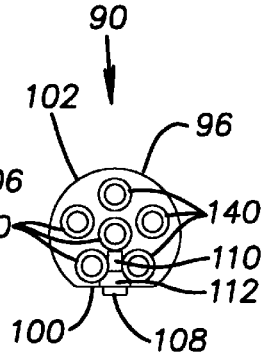
FIG. 4 is a posterior end view of the electrical connector.
Figure 5:
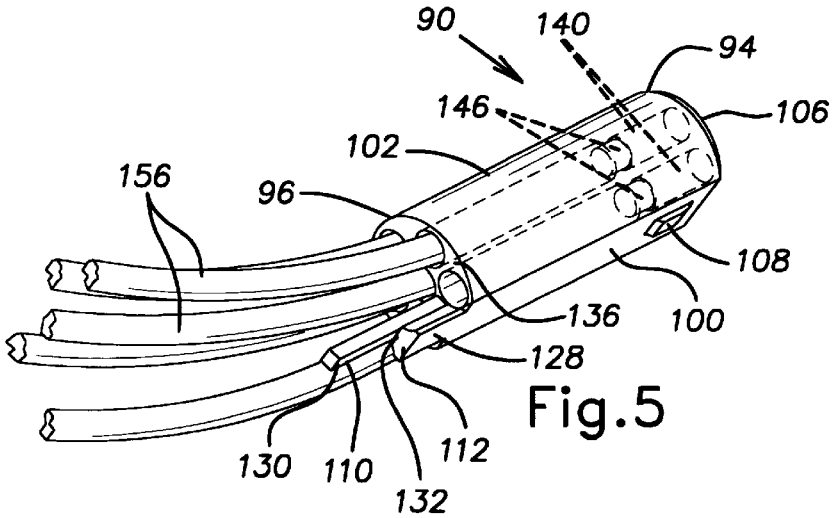
FIG. 5 is a perspective view of the electrical connector.
Figure 9:
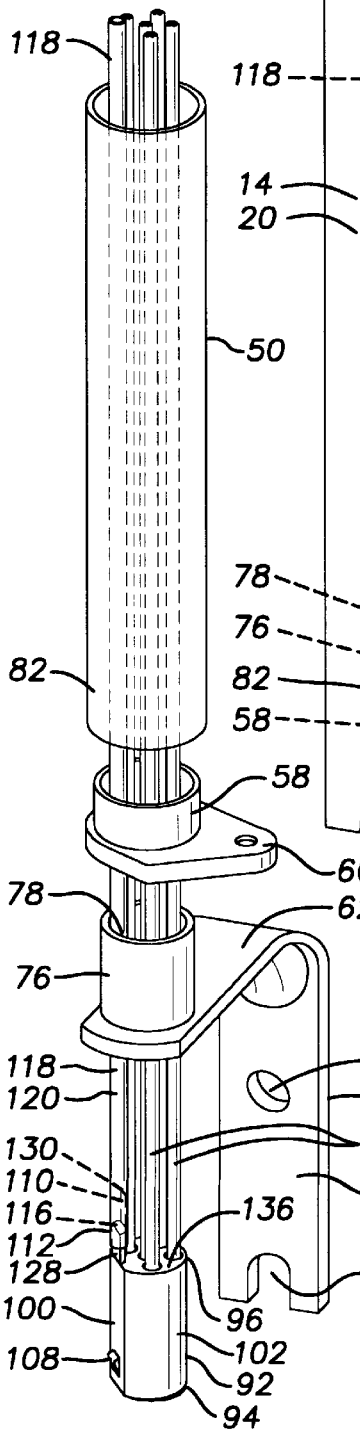
FIG. 9 is a perspective view of the electrical connector assembly inserted through an exploded view of the conduit and door hinge.

The electrical connector 90 is provided with a locator 110 protruding from the posterior end 96 and a stop surface 112 located adjacent the locator 110 and posterior end 96. The locator 110 is shaped to fit inside an end section 116 of a hollow member 118 (FIG. 9). As will be discussed in more detail below, the hollow member 118 is used to push the electrical connector 90 through the conduit 50, bushing 58, and the hole 78 in the lower door hinge 46. Since a water tube 120 must also be inserted into the conduit 50 to supply the devices 42 with a supply of water, the water tube 120 is an ideal implement to serve as the hollow member 118. The stop surface 112 engages the end 116 of the hollow member 118, or water tube 120, and is adapted to receive a force applied on the connector 90 by the water tube 120. To serve this purpose, there are many possible configurations for the physical structure of the locator 110 and the stop surface 112. For example, as shown in FIGS. 2 and 5, the locator 110 may have a first portion 128 extending from the posterior end 96 and a second portion 130 projecting from an outer end face 132 of the first portion 128 and away from the posterior end 96. In this case, the outer end face 132 defines the stop surface 112. As best shown in FIG. 4, the electrical connector 90 has a peripheral edge and a center, and the locator 110 is relatively closer to the peripheral edge than the center.

Figure 11:
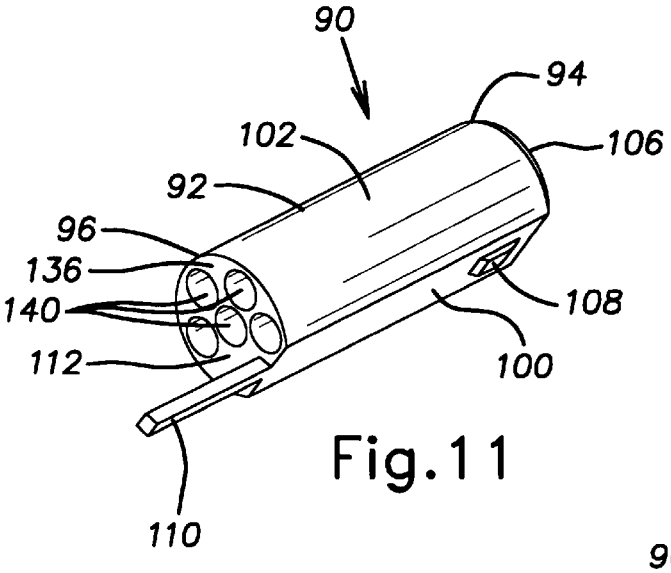
FIG. 11 is a perspective view of a second embodiment of the electrical connector.
Figure 12:
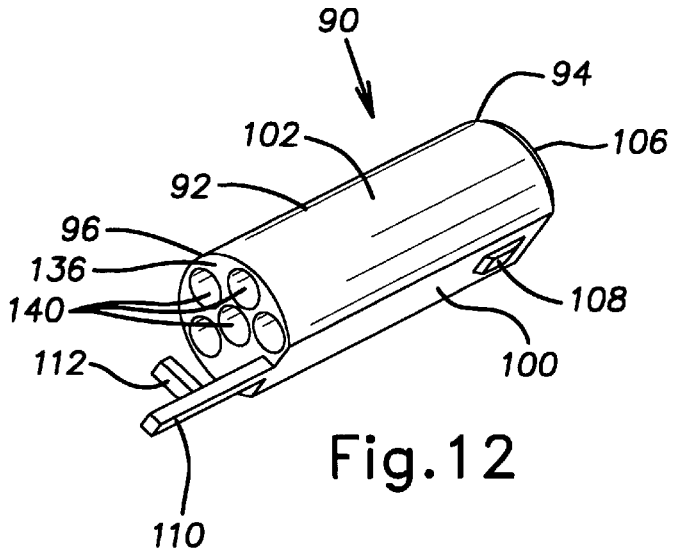
FIG. 12 is a perspective view of a third embodiment of the electrical connector.
Figure 13:
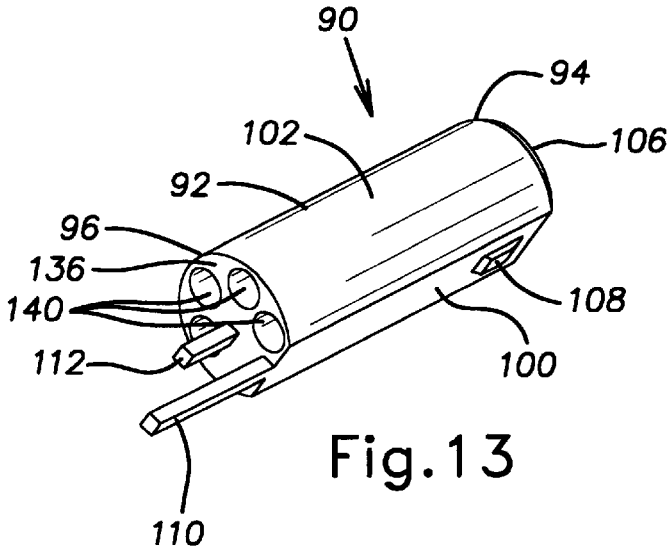
FIG. 13 is a perspective view of a fourth embodiment of the electrical connector.

Second, third and fourth embodiments of electrical connectors 90 are shown in FIGS. 11–13 as examples of different configurations of the connectors 90. The electrical connector 90 may be configured such that the posterior end 96 has an end surface 136 and the stop surface 112 is part of the end surface 136 (FIG. 11) or the stop surface 112 is spaced apart from the end surface 136 (FIGS. 12 and 13).

Figure 7:
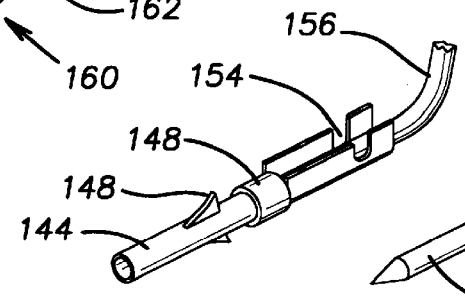
FIG. 7 is a perspective view of a sleeve connector for the electrical connector.

The electrical connector body 92 is also provided with a number of passages 140 extending between the anterior 94 and posterior 96 ends of the connector 90. The passages 140 are substantially parallel to the longitudinal axis of the body 92. An electrically conductive sleeve connector 144 (FIG. 7) is disposed within each of the passages 140 toward the anterior end 94 of the passages 140. Each of the passages 140 has a constriction 146 near the center of the electrical connector body 92. The sleeve connectors 144 have widened sections 148 that sandwich the constriction 146 thus preventing movement of the sleeve connector 144 in a direction parallel to the longitudinal axis of the body 92. The result is that the sleeve connectors 144 are retained in the passages 140 and will not exit the body 92 during installation of the connector 90 in the refrigerator 14.

The sleeve connectors 144 are also provided with crimp contacts 150 for electrically connecting each of the sleeve connectors 144 with an end 154 of a wire 156. The wires 156 enter each of the passages 140 from the posterior end 96 of the connector body 92 and are crimped to the sleeve connectors 144. The crimp contacts 150 not only provide an electrical connection between the sleeve connectors 144 and the wires 156, but retain the ends 154 of the wires 156 in the electrical connector 90. Solder cup contacts, or other means of connecting the sleeve connectors 144 with the wires 156, may also be used instead of crimp contacts 150, if desired.

Figure 6:
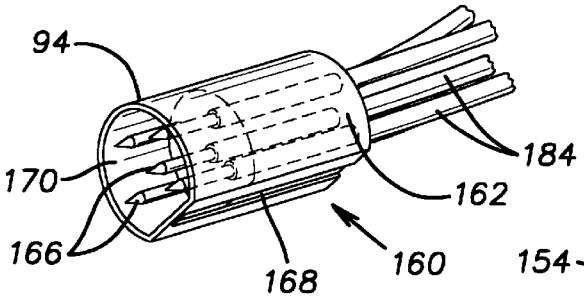
FIG. 6 is a perspective view of a mating connector.
Figure 8:
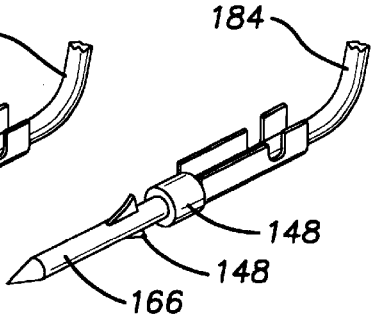
FIG. 8 is a perspective view of a pin connector for the mating connector.

The refrigerator 14 is also provided with a mating connector 160 for the electrical connector 90. The mating connector 160 may take the form of a wiring harness 162 as shown in FIG. 6, or a receptacle (not shown). The mating connector 160 is essentially the same as the electrical connector 90 thus far described but with a few differences. The mating connector 160 is not provided with a locator 110 or stop surface 112. Instead of being provided with sleeve connectors 144, the mating connector is provided with pins 166 (FIG. 8). Instead of being provided with a catch 108, the mating connector 160 is provided with a slot 168. As described in more detail below, the slot 168 is used to engage the catch 108. An anterior end 169 of the mating connector 160 is provided with a recess 170, in which the pins 166 are disposed. The recess 170 is sized and shaped to accommodate the anterior end 94, of the electrical connector 90. When the anterior ends 94, 169 of the two connectors 90, 160 are aligned and pushed together, the pins 166 fit within and electrically connect to the sleeves 144, and the catch 108 becomes engaged in the slot 168. The engagement of the catch 108 in the slot 168 prevents the accidental detachment of the two connectors 90, 160. It should be understood that the mating connector 160 can be provided with a locator 110 and a stop surface 112. If provided with these features, the mating connector 160 will have the capability to serve as the electrical connector 90 that is installed through the conduit 50 and hole 78 in the lower hinge 46.

Briefly referring to FIG. 10, the water tube 120 connects to a water source 174. The water source 174 may be located in the refrigerator 10 or external to the refrigerator 10. The water source 174 has a supply line 176 and a coupling 178 for connecting the water source 174 to the water tube 120.

Referring now to FIG. 9, the installation of the electrical connector 90 is shown. The installation process begins with assembling the electrical connector 90 and the hollow member 118, or water tube 120, by inserting the locator 110 inside the water tube 120. The end 116 of the water tube 120 will contact the stop surface 112. The anterior end 94 of the electrical connector 90 is then aligned with an upper end 182 of the conduit 50. Downward force is then applied to the water tube 120 to push the water tube 120 against the stop surface 112. The pushing action forces the electrical connector 90, wires 156 and water tube 120 downwardly through the conduit 50 and then through the bushing 58 and hole 78 in the lower door hinge 46. The bevel 106 assists in the alignment and insertion of the electrical connector 90 by providing a smaller diameter body 92 and the very first part of the connector 90 to enter and pass through the conduit 50, bushing 58 and hole 78.

Since there is a limited amount of space on the end surface 136 of the connector posterior end 96, the end 116 of the water tube 120 may crush the wires 156 against the end surface 136 should the water tube 120 be allowed to get too close to the end surface 136. Therefore, the stop surface 112 is preferably spaced apart from the posterior end 96 so that when the end 116 of the water tube 120 is pressed against the stop surface 112, the end 116 of the water tube 120 does not crush the wires 156.

Once the connector 90 is installed through the conduit 50 and hinge 46, the assembly consisting of the electrical connector 90 and water tube 120 may be disassembled by removing the locator 110 from the water tube 120. The electrical connector 90 is then mated with the mating connector 160 in the manner already described. If the water tube 120 is used as the hollow member 118, then the water tube 120 may be mated with a water source 174 by connecting the water tube 120 to the coupling 178. For convenience, the water source 174 and the mating connector 160 may be located adjacent the lower door hinge 46. The mating connector 160 wires 184 and the water source 174 have their origins elsewhere in the refrigerator 10 and pass through a hole 186 cut in the toeplate 72, as shown in FIG. 10.

The present invention provides a highly efficient means of installing electrical and water supply lines within refrigerator doors 14. This is because electrical wires 156 and plumbing (the water tube 120) may be simultaneously installed in the refrigerator door 14 by using the water tube 120 as an insertion tool for the wires 156.

Although particular embodiments of the invention have been described in detail, it is understood that the invention is not limited correspondingly in scope, but includes all changes and modifications coming within the spirit and terms of the claims appended hereto. As an example, one of the wires 156 extending from the posterior end 96 may be used as the locator 110. Specifically, the wire 156 may be fed through the water tube 120 so that the end 116 of the water tube 120 contacts the end surface 136 of the posterior end 96 of the connector 90 or a stop surface 112. The assembly may then be inserted in the same manner described. Once the insertion is completed the water tube 120 may be backed away from the electrical connector 90, the wire 156 used as the locator 110 may be severed and then the severed wire 156 may be pulled through water tube 120 and discarded.

Another example is an electrical connector 90 wherein the connector 90 is provided with a recess on the posterior end 96 of the connector 90 in lieu of a locator 110 and stop surface 112. The recess would retain the water tube 120 during installation. This example can be further modified such that one of the passages 140 would retain the water tube 120 rather than retaining a sleeve connector 144 and wire 156. By using this assembly in conjunction with a mating connector 160 designed to supply both electrical power and water, the number of parts, and steps required to install them, will be reduced.

What is claimed is:

1. An electrical connector assembly for use in a refrigerator, comprising a hollow member; and an electrical connector having an anterior end and a posterior end, a locator protruding from the posterior end of the connector, a stop surface adjacent the locator and the posterior end of the connector, and passages extending between the posterior and anterior ends of the connector wherein said connector is inserted through a hole by force acting upon said stop surface by the hollow member, and said locator being received within said hollow member.

2. The connector assembly according to claim 1, wherein the locator has a first portion extending from the posterior end of the connector and a second portion projecting from the first portion away from said posterior end.

3. The connector assembly according to claim 2, wherein said locator first portion has an outer end face from which said second portion extends, said outer end face defining said stop surface.

4. The connector assembly according to claim 1, wherein said electrical connector has a peripheral edge and a center, said locator being relatively closer to said peripheral edge than said center.

5. The connector according to claim 1, wherein the posterior end has an end surface and the stop surface is spaced apart from the posterior end surface.

6. The connector according to claim 1, wherein a conductive connector is disposed within at least one of the passages toward the anterior end and a wire is disposed within the passage having the conductive connector, wherein the wire extends beyond the posterior end and is in electrical association with the conductive connector.

7. A refrigerator, comprising a refrigerator door, the refrigerator door defining a conduit; a hollow member; and an electrical connector having an anterior end and a posterior end, a locator protruding from the posterior end of the connector, a stop surface adjacent the locator and the posterior end of the connector, and passages extending between the posterior and anterior ends of the connector wherein said connector is inserted through the conduit by force acting upon said stop surface by the hollow member, said locator being received within said hollow member.

8. The refrigerator according to claim 7, wherein the hollow member is a water tube.

9. The refrigerator according to claim 7, wherein the locator has a first portion extending from the posterior end of the connector and a second portion projecting from the first portion away from said posterior end.

10. The refrigerator according to claim 9, wherein said locator first portion has an outer end face from which said second portion extends, said outer end face defining said stop surface.

11. The refrigerator according to claim 7, wherein said electrical connector has a peripheral edge and a center, said locator being relatively closer to said peripheral edge than said center.

12. The connector according to claim 7, wherein the posterior end has an end surface and the stop surface is spaced apart from the posterior end surface.

13. The connector according to claim 7, wherein a conductive connector is disposed within at least one of the passages toward the anterior end and a wire is disposed within the passage having the conductive connector, wherein the wire extends beyond the posterior end and is in electrical association with the conductive connector.

* * * * *